US006972385B2

(12) United States Patent
Krebs et al.

(10) Patent No.: US 6,972,385 B2
(45) Date of Patent: Dec. 6, 2005

(54) OPERATING DEVICE FOR MANUAL ACTUATION OF HOISTING EQUIPMENT

(75) Inventors: Wolfgang Krebs, Wetter (DE); Holger Freitag, Bochum (DE); Anton Münzebrock, Dortmund (DE); Burkhard Hasenack, Hagen (DE); Giuliano Persico, Wetter (DE); Erik Appel, Wetter (DE); Stefan Elspass, Tönisvorst (DE)

(73) Assignee: Demag Cranes & Components GmbH, Wetter (DE)

( * ) Notice: Subject to any disclaimer, the term of this patent is extended or adjusted under 35 U.S.C. 154(b) by 25 days.

(21) Appl. No.: 10/888,330

(22) Filed: Jul. 9, 2004

(65) Prior Publication Data

US 2005/0034966 A1 Feb. 17, 2005

(30) Foreign Application Priority Data

Jul. 9, 2003 (DE) ..... 103 31 130

(51) Int. Cl.[7] ..... H01H 9/00
(52) U.S. Cl. ..... 200/1 B; 200/302.2
(58) Field of Search ..... 200/1 B, 5 B, 200/310, 329, 341, 302.1–302.3; 335/205–207

(56) References Cited

U.S. PATENT DOCUMENTS 2,489,185 A * 11/1949 Johnson ..... 200/16 A
5,665,947 A * 9/1997 Falcon ..... 200/61.18
5,938,589 A 8/1999 Wako et al. ..... 600/159

FOREIGN PATENT DOCUMENTS

| | | |
|---|---|---|
| DE | 2847281 C2 | 12/1982 |
| DE | 3302793 | 1/1984 |
| DE | 3910837 A1 | 10/1990 |
| DE | 19727553 A1 | 10/1998 |
| DE | 20004887 U1 | 8/2000 |
| DE | 10232399 A1 | 7/2003 |
| JP | 8264069 | 10/1996 |

OTHER PUBLICATIONS

European Search Report completed Oct. 21, 2004, from corresponding European Application No. EP 04 01 5168.
Schmelcher, Von Theodor, "Niederspannungs-schaltgerate, " Berlin und München: Siemens AG, 1973, S. 9 und 10.

* cited by examiner

*Primary Examiner*—Elvin G. Enad
*Assistant Examiner*—Lisa Klaus
(74) *Attorney, Agent, or Firm*—Van Dyke, Gardner, Linn & Burkhart, LLP

(57) ABSTRACT

An operating device for the manual actuation of hoisting equipment, with at least one spring-loaded switch element (2) for each direction of movement of the lifting device arranged in a switch housing (1), wherein each switch element (2) includes a pressure activation mechanism (5), a first electrical micro-key button (4), and at least one additional control or switch element, especially another electrical micro-key button (6), and the pressure activation mechanism (5) is arranged in front of the micro-key button (4) and the additional control or switch element and these can be activated in succession by means of such structure.

31 Claims, 2 Drawing Sheets

OPERATING DEVICE FOR MANUAL ACTUATION OF HOISTING EQUIPMENT

BACKGROUND OF THE INVENTION

The invention is directed to an operating device for the manual actuation of hoisting equipment and, in particular, to such an operating device with at least one spring-loaded switch element arranged in a switch housing for each direction of movement of the hoisting device.

Control signals for hoisting equipment are often generated in practice with specially developed pushbuttons, whose manufacture involves high expense on parts, material, and assembly. Because the force/travel relationship of the pushbutton must be of such kind that the operating personnel can easily find and effortlessly maintain the intended position of the thumb for activation of the pushbutton, even when wearing work gloves, one requires switching distances of at least 5 mm, on the one hand, and clearly distinguishable locking positions for fast and slow operation, on the other.

From DE 44 12 557 C2, one such special component is known for converting an actuation distance into an electrical signal. Although these familiar switches have worked very well in practice, their manufacture and assembly involve high cost.

Based on the mentioned need for distinct and long switching distances, it has not been possible thus far to use the familiar and cheap standard pushbuttons, since these have only very short switching distances and low switch forces.

Furthermore, from German application DE 102 32 399 A1 there is known a two-stage switch, which essentially consists of a pressure activation mechanism that acts consecutively on two micro-key buttons. The pressure activation mechanism has the task of converting the switching force usually applied by an operator with his thumb into an axial movement, which then brings about the activation of the micro-key button. For this, the pressure activation mechanism is configured as an axially moveable outer plunger, which is preloaded by a spring against the switching force. In the outer plunger are arranged two inner plungers, parallel and alongside each other, for activating the micro-key button. These inner plungers can move axially in the outer plunger and are supported parallel to the direction of movement of the outer plunger and spring-loaded relative to the outer plunger. The length of the inner plunger is chosen so that, when the outer plunger is activated in a first switching step, the first of the two micro-key buttons is activated. Upon further activating of the outer plunger, the first micro-key button is held down by the first inner plunger, the first inner plunger moves further into the outer plunger, and the second inner plunger then activates the other micro-key button. Thus, with these two-stage switches, one can start pole-reversing drive motors running at their low or high speed, for example. In addition, locking elements are provided on the outer plunger, in order to furnish definite pressure points when activating the outer plunger, coinciding with the activation of the micro-key buttons. Furthermore, the pressure activation mechanism is protected on the outside against weather factors by a flexible protective cap. The preferred area of application indicated for such a two-stage switch are wireless or cable-operated manual controllers for cranes, construction machinery, or similar industrial machines.

SUMMARY OF THE INVENTION

Accordingly, the basic problem of the invention is to create an operating device for the manual actuation of hoisting equipment that guarantees the safety-relevant requirements for a distinct switching distance and sufficiently large switch forces in a simple and economical layout.

The solution of this problem is characterized according to the invention in that the pressure activation mechanism consists of an outer plunger that is spring-loaded against the electrical micro-key button and the additional control or switch element and an inner plunger spring-loaded inside the outer plunger, and the first micro-key button can be activated by the inner plunger and the additional control or switch element can be activated by the outer plunger. Advantageous embodiments of the invention are disclosed.

As a result of the invented configuration of the switch elements with a separation between electrical switching and mechanical activation, it is possible to use standard commercial electrical switches for the actual electrical switching, such as micro-key buttons that can be soldered onto a circuit board. The short contact travel and low switching forces of these economical standard components are compensated by the preceding pressure activation mechanism. The kinematics of the pressure activation mechanism can be easily and cheaply configured so that all safety-relevant switch criteria can be fulfilled. Advantageously, the at least one additional control or switch element is also a micro-key button. This additional switch element, which is needed for switching to fast duty, can therefore also be implemented cheaply with a standard electrical switch.

For example, besides switching between the lifting and lowering directions of movement, in order to also switch between slow and fast speed, the invention proposes that it be possible for the pressure activation mechanism to successively activate first the first micro-key button and then the at least one additional control and switch element.

An especially advantageous construction, favoring a compact design, is one in which the inner plunger is concentrically mounted inside the outer plunger and the first micro-key button is arranged with its switching plunger concentric to the inner plunger. This is also supported by features such that the at least one additional micro-key button is arranged with its switching plunger eccentric to the inner plunger and set off sideways from the first micro-key button and it can be activated by a bearing surface firmly joined to the outer plunger. This accomplishes the forced activation of the second micro-key button or additional switch element by having the activating force act with no flexible force-transmitting elements, which is advantageous for safety reasons.

An especially advantageous design configuration of the operating device is achieved in that at least one pair of switch elements are arranged in a switch housing for different directions of movement of the hoisting device, a first micro-key button and an additional shared control or switch element, especially another micro-key button, are coordinated with each pressure activation mechanism. It is preferable here to arrange the additional shared control or switch element between the first two micro-key buttons. Thanks to this combination, it is possible to further reduce the number of individual components needing to be installed and thereby further lower the overall fabrication and assembly costs.

According to one practical embodiment of the invention, it is proposed that the pressure activation mechanism have a bearing surface to activate the first micro-key button and that at least one spring element be arranged between the pressure activation mechanism and the first micro-key button, by which the pressure activation mechanism is preloaded in the forward pointing direction of the first micro-key button, especially its switching plunger. By the dimensioning and the spring force of this spring element, one can easily and cheaply adjust both the contact travel and the switching force.

Furthermore, the invention proposes that a bearing surface is formed on the outer plunger for activating the at least one additional control or switch element.

According to an alternative embodiment, the invention proposes that the at least one additional control or switch element is a Hall sensor interacting with a magnet for continuous control of the motion of the hoisting device in the second switch stage. Here, the magnet connected to the outer plunger will move in the direction of a Hall sensor in place of the additional switch element. The Hall sensor measures the magnetic field for continuous control of the movement of the hoisting device.

Finally, the invention proposes that the pressure activation mechanisms can be sealed off from the switch housing by a flexible protective cap, in order to prevent dirt and/or moisture from getting into the switch housing.

Because the pressure activation mechanisms can be locked in the individual switch positions relative to the housing, the operator in advantageous manner receives a tactile feedback in terms of the activating force when switching the contacts. The operating force at first increases as the switching point is approached and decreases after reaching the switching point.

In advantageous configuration, the outer plunger is provided with at least two spring-loaded locking lugs, which engage with locking grooves in the individual switch positions of the operating device. The locking grooves are arranged in the inner wall of a bushing and the bushing is secured in the switch housing to guide the outer plunger.

Additional features and benefits of the invention will result from the corresponding drawing, which depicts a sample embodiment of an operating device according to the invention for manual actuation of hoisting equipment, simply as a schematic example, in a partial longitudinal section.

DESCRIPTION OF THE PREFERRED EMBODIMENT

Figure 1:
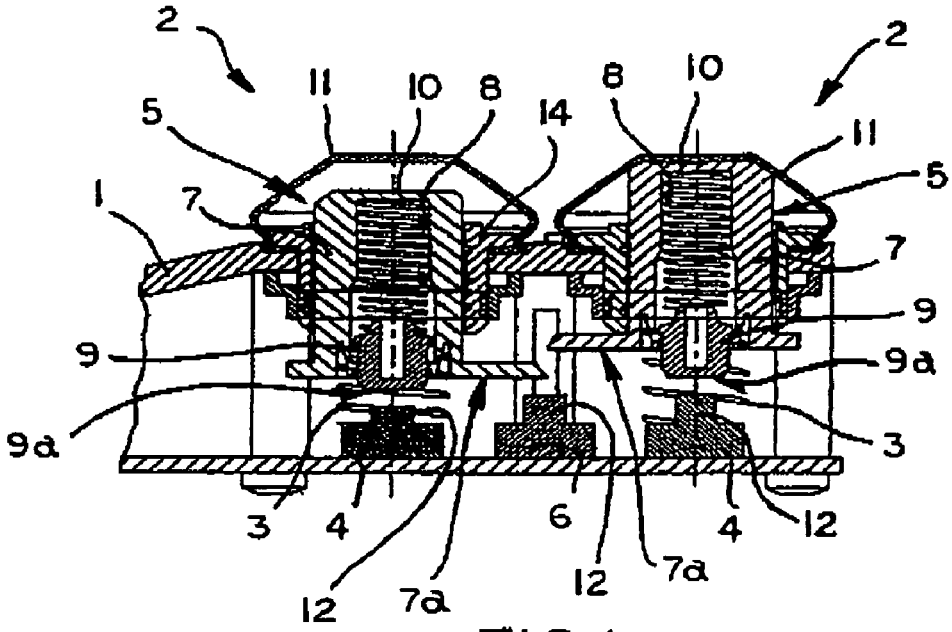
FIG. 1 is a sectional view of an operating device for the manual actuation of hoisting equipment, according to the invention.

The sample embodiment shown partially in FIG. 1 for an operating device for the manual actuation of hoisting equipment essentially consists of switch housing 1 and two switch elements 2 arranged in the switch housing 1. These two switch elements 2 serve to activate the two possible different directions of movement of the hoisting device, namely lifting and lowering.

For safety reasons, the switch elements 2 of an operating device for the manual actuation of hoisting equipment must be designed so that a switch element 2 that is activated is returned at once to the basic off position as soon as no further pressure is exerted on the switch element 2. For this purpose, each switch element 2 is preloaded by a spring element 3 in the direction of the basic off position.

As is further evident from the diagram, each of the two switch elements 2 consists of an electrical first micro-key button 4 and a preceding pressure activation mechanism 5, by which the first micro-key button 4 can be activated. The standard commercial first micro-key button 4 can be soldered directly on a circuit board. Thanks to the use of these familiar standard components, one can avoid the familiar use of special components which are costly and hard to fabricate. In connection with the present invention, by a micro-key button is meant a miniaturized switch element for the switching of signal currents with spring-loaded electrical contacts, which is switched with short travel by activating a key. Micro-key buttons can be automatically mounted on electrical circuit cards in an ideal manner and require little installation space.

Thanks to this spatial separation of the actual electrical switching by the first micro-key button 4 from the mechanical switching by the pressure activation mechanism 5, it becomes possible to use micro-key buttons 4, which require only short contact travel and low switching forces. The large contact travel and conspicuous switching forces prescribed for a safe handling can be achieved easily and cheaply in this embodiment by the kinematics of the pressure activation mechanism 5 preceding the micro-key button 4.

Furthermore, the depicted sample embodiment of an operating device for the manual actuation of hoisting equipment is configured such that an additional shared micro-key button 6 is coordinated with the two switch elements 2 for lifting and lowering, by means of which a fast duty of the hoisting device can be activated for the particular direction of movement. This shared micro-key button 6 is activated by the particular pressure activation mechanism 5 for the desired direction of movement.

It is also possible, of course, to coordinate an additional micro-key button 6 with each switch element 2.

In any case, the pressure activation mechanism 5 is configured such that the additional micro-key button 6 can only be activated in time sequence after the activation of one of the first micro-key buttons 4, that is, the hoisting device can only be switched to the slow lifting or lowering operation before it is possible for the fast operation to be turned on by activating the additional micro-key button 6.

To carry out the successive switching function, namely, the activating of the electrical first micro-key button 4 of the switch element 2, on the one hand, and the subsequent activating of the additional micro-key button 6, on the other, the pressure activation mechanisms 5 of the switch elements 2 each consist of an outer plunger 7, preloaded by the spring element 3 against the corresponding electrical switching means 4 of the switch element 2, and an inner plunger 9, guided and mounted in a borehole 8 of the outer plunger 7, while the inner plunger 9 thrusts against the outer plunger 7 by a spring element 10 mounted in the borehole 8. In this way, the inner plunger 9 can move coaxially in the outer plunger 7.

In order to prevent moisture and/or dirt from getting into the switch housing 1, the pressure activation mechanisms 5 are sealed off with a flexible protective cap 11 against the switch housing 1.

The activating of the above-described operating device for the manual actuation of hoisting equipment occurs as follows:

Upon exerting a pressing force on the protective cap 11 covering a switch element 2, the pressure is transmitted to the outer plunger 7 of the pressure activation mechanism 5 and the outer plunger 7 moves against the restoring force of the spring element 3 in the direction of the corresponding electrical micro-key button 4, in particular, its switching plunger 12, of the switch element 2. The inner plunger 9, mounted by the spring element 10 in the outer plunger 7, is carried along freely during this movement until the inner plunger 9 by a bearing surface 9*a* comes up against the first micro-key button 4 or its switching plunger 12, and the latter triggers the electrical switching. The inner plunger 9 in this case is mounted coaxially to the switching plunger 12 of the first micro-key button 4.

If, now, further pressure is exerted on the outer plunger 7 of the pressure activation mechanism 5, this pressure on the one hand will compress the spring element 10 via the inner plunger 9 resting against the first micro-key button 4, thus loading the first micro-key button 4, and on the other hand the outer plunger 7 will be pressed into the switch housing 1 against the restoring force of the spring element 3 until a bearing surface 7*a* of the outer plunger 7 thrusts against the switching plunger 12 of the additional micro-key button 6 and thus activates the fast duty.

For a better understanding of the construction of the switch elements 2, the switch element 2 located in the switching position at the left side of the diagram is not represented exactly in the depressed condition. Actually, in the switching position, the inner plunger 9 would have to thrust, by the bearing surface 9*a,* against the first micro-key button 4, especially its switching plunger 12.

Thanks to the spring elements 3 and 10, the switch elements are designed so that the activating of the micro-key buttons 4, 6 is interrupted as soon as no more pressure is exerted on the switch elements 2.

Besides the depicted option, it is also possible to configure the additional micro-key button 6 as a Hall sensor interacting with a magnet for continuous speed governance of the hoisting device in the second switching stage.

The above-described operating device for the manual actuation of hoisting equipment is characterized by the separation of the actual electrical switching from the mechanical activation, which makes it possible to use conventional standard components to fashion the switching contacts, especially of the electrical micro-key buttons 4, 6, while preserving all safety-relevant switching criteria, such as contact travel and switching force.

Figure 2:
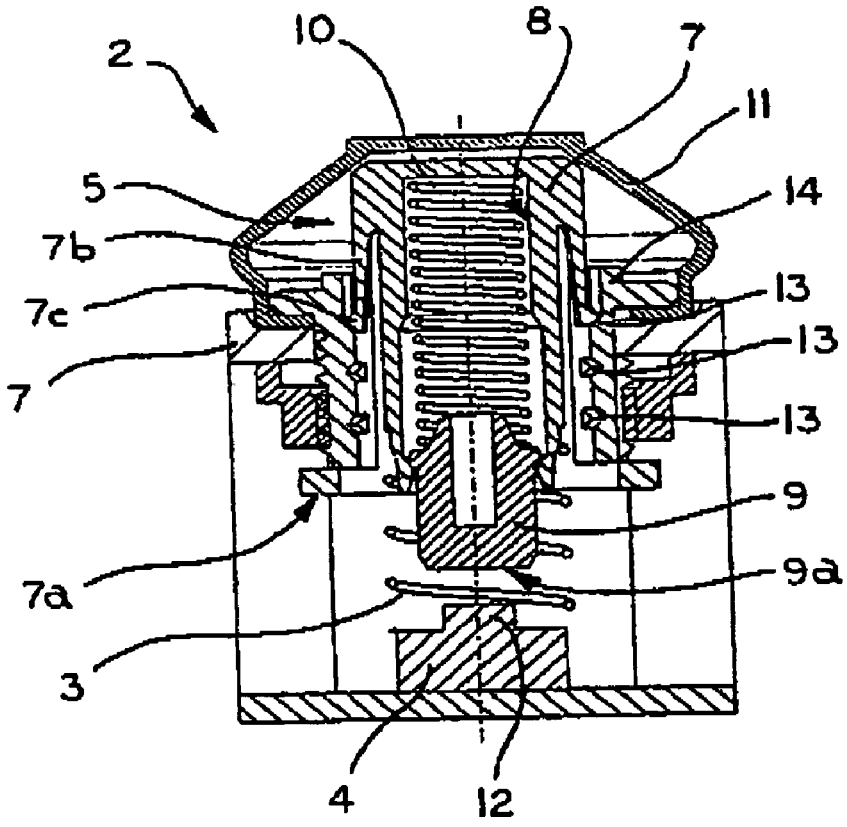
FIG. 2 is the same view as FIG. 1 of an alternative embodiment of an operating device for the manual actuation of hoisting equipment.

FIG. 2 shows a feature of a second sample embodiment of an operating device for the manual actuation of hoisting equipment. This operating device basically coincides with the operating device already described and shown in FIG. 1. Therefore, the same reference numbers are also used for the same parts.

For the operation of the switched drives of a lifting device by means of an operating device, it is advantageous to provide the operator a tactile feedback through the actuating force when switching the switch contacts 2. This can be done in that the operating force when approaching the switching point at first increases and after reaching the switching point it decreases. For this, the outer plunger 7, which is guided in a bushing 14 held in the switch housing 1, is outfitted with a flexible tongue 7*b* oriented concentrically to the lengthwise axis of the outer plunger 7. This flexible tongue 7*b* has, at its free end pointing downward in the direction of pressing, an outwardly pointing locking lug 7*c,* which snaps into one or more consecutively arranged locking grooves 13 during the downward movement or pressing movement of the outer plunger, depending on the number of switching stages. The locking grooves 13 are arranged accordingly in the region of the inner wall of the bushing 14. In the engaged position of the locking lug 7*c* with one of the three locking grooves 13 arranged one after the other at a spacing from each other, looking in the direction of activation of the outer plunger 7, the pressing force which the operator has to exert in order to hold the switch position is reduced. In order to leave this position, for example, the slow mode, and reach the next, deeper switch position, or fast mode, one must first apply a noticeably greater force in order to move the locking lug 7*b* out of the locking groove 13.

Changes and modifications in the specifically described embodiments can be carried out without departing from the principles of the invention which is intended to be limited only by the scope of the appended claims, as interpreted according to the principles of patent law including the doctrine of equivalents.

The embodiments of the invention in which an exclusive property or privilege is claimed are defined as follows:

1. An operating device for the manual actuation of hoisting equipment, with at least one spring-loaded switch element for each direction of movement of the lifting device arranged in a switch housing, wherein said at least one spring-loaded switch element comprises:

a pressure activation mechanism, a first electrical micro-key button, and at least one additional control or switch element, wherein said pressure activation mechanism is arranged in front of said micro-key button and said additional control or switch element, wherein said micro-key button and said control or switch element can be activated in succession; and wherein said pressure activation mechanism comprises an outer plunger and an inner plunger, said outer plunger being spring-loaded against said electrical micro-key button and said additional control or switch element, said inner plunger being spring-loaded inside said outer plunger, wherein said first micro-key button is selectively activated by said inner plunger and said additional control or switch element is selectively activated by said outer plunger.

2. The operating device of claim 1, wherein said at least one additional control or switch element comprises another micro-key button.

3. The operating device of claim 2, wherein said pressure activation mechanism selectively initially activates said first micro-key button and then said at least one additional control or switch element.

4. The operating device of claim 3, wherein said inner plunger is mounted concentrically in said outer plunger.

5. The operating device of claim 4, wherein said first micro-key button is arranged with its switching plunger concentric to said inner plunger.

6. The operating device of claim 5, wherein said at least one additional micro-key button is arranged with its switching plunger eccentrically to said inner plunger and set off sideways from said first micro-key button.

7. The operating device of claim 6, wherein said at least one spring-loaded switch element comprises at least one pair of spring-loaded switch elements that are arranged in a switch housing for different directions of movement of the hoisting device, said at least one pair of spring-loaded switch elements comprising another first micro-key button and an additional shared control or switch element that are coordinated with each pressure activation mechanism.

8. The operating device of claim 7, wherein said additional shared control or switch element is arranged between said first micro-key button.

9. The operating device of claim 8, wherein said pressure activation mechanism is preloaded by at least one spring element in said forward-pointing direction of the first micro-key button.

10. The operating device of claim 9, wherein said pressure activation mechanism has a bearing surface for activating said first micro-key button and at least one spring element that is arranged between said pressure activation mechanism and said first micro-key button.

11. The operating device of claim 10, including a bearing surface formed on said outer plunger to activate said at least one additional control or switch element.

12. The operating device of claim 11, wherein said pressure activation mechanism is sealed off from the outside relative to the switch housing by a flexible protective cap.

13. The operating device of claim 12, wherein said pressure activation mechanism is adapted to be interlocked in individual switch positions relative to said switch housing.

14. The operating device of claim 13, wherein said outer plunger includes at least two flexible locking lugs, which engage with locking grooves in said individual switch positions.

15. The operating device of claim 14, wherein said locking grooves are arranged in the inner wall of a bushing and said bushing is secured in the switch housing to guide said outer plunger.

16. The operating device of claim 1, wherein said at least one additional control or switch element comprises a Hall sensor interacting with a magnet for continuous control of the motion of the hoisting device.

17. The operating device of claim 1, wherein said pressure activation mechanism selectively initially activates said first micro-key button and then said at least one additional control or switch element.

18. The operating device of claim 1, wherein said inner plunger is mounted concentrically in said outer plunger.

19. The operating device of claim 18, wherein said first micro-key button is arranged with its switching plunger concentric to said inner plunger.

20. The operating device of claim 19, wherein said at least one additional micro-key button is arranged with its switching plunger eccentrically to said inner plunger and set off sideways from said first micro-key button.

21. The operating device of claim 1, wherein said first micro-key button is arranged with its switching plunger concentric to said inner plunger.

22. The operating device of claim 1, wherein said at least one additional micro-key button is arranged with its switching plunger eccentrically to said inner plunger and set off sideways frown said first micro-key button.

23. The operating device of claim 1, wherein said at least one spring-loaded switch element comprises at least one pair of spring-loaded switch elements that are arranged in a switch housing for different directions of movement of the hoisting device, said at least one pair of spring-loaded switch elements comprising another first micro-key button and an additional shared control or switch element chat are coordinated with each pressure activation mechanism.

24. The operating device of claim 23, wherein said additional shared control or switch element is arranged between said first micro-key button.

25. The operating device of claim 1, wherein said pressure activation mechanism is preloaded by at least one spring element in said forward-pointing direction of the first micro-key button.

26. The operating device of claim 1, wherein said pressure activation mechanism has a bearing surface for activating said first micro-key button and at least one spring element that is arranged between said pressure activation mechanism and said first micro-key button.

27. The operating device of claim 1, including a bearing surface formed on said outer plunger to activate said at least one additional control or switch element.

28. The operating device of claim 1, wherein said pressure activation mechanism is sealed off from the outside relative to the switch housing by a flexible protective cap.

29. The operating device of claim 1, wherein said pressure activation mechanism is adapted to be interlocked in individual switch positions relative to said switch housing.

30. The operating device of claim 29, wherein said outer plunger includes at least two flexible locking lugs, which engage with locking grooves in said individual switch positions.

31. The operating device of claim 30, wherein said locking grooves are arranged in the inner wall of a bushing and said bushing is secured in the switch housing to guide said outer plunger.

* * * * *

UNITED STATES PATENT AND TRADEMARK OFFICE

CERTIFICATE OF CORRECTION

PATENT NO. : 6,972,385 B2
APPLICATION NO. : 10/888330
DATED : December 6, 2005
INVENTOR(S) : Wolfgang Krebs et al.

It is certified that error appears in the above-identified patent and that said Letters Patent is hereby corrected as shown below:

Column 8:
Line 4, Claim 22, “frown” should be --from--.
Line 11, Claim 23, “chat” should be --that--.

Signed and Sealed this

Eighteenth Day of March, 2008

JON W. DUDAS
*Director of the United States Patent and Trademark Office*